United States Patent [19]

Minoda et al.

[11] 3,936,306

[45] Feb. 3, 1976

[54] PROCESS FOR PRODUCING GELATINO-SILVER HALIDE PHOTOGRAPHIC LIGHT-SENSITIVE MATERIALS HAVING A HIGH SILVER HALIDE CONTENT

[75] Inventors: Minoru Minoda; Haruo Masuda; Mitsuru Suzuki; Hirohi Chikamasa, all of Kanagawa, Japan

[73] Assignee: Fuji Photo Film Co., Ltd., Kanagawa, Japan

[22] Filed: June 28, 1974

[21] Appl. No.: 484,018

Related U.S. Application Data

[63] Continuation of Ser. No. 35,547, May 7, 1970, abandoned.

[30] Foreign Application Priority Data

May 7, 1969 Japan ..... 44-34967

[52] U.S. Cl. ..... 96/87 R; 427/377; 427/379; 427/380

[51] Int. Cl.[2] ..... G03C 1/76

[58] Field of Search .... 96/94, 50, 114.7, 67, 50 PL; 117/119.6; 427/377, 379, 380

[56] References Cited

UNITED STATES PATENTS

| | | | |
|---|---|---|---|
| 2,611,716 | 9/1952 | Robijns | 96/114.7 |
| 3,039,871 | 6/1962 | Scott | 96/114.7 |
| 3,507,678 | 4/1970 | Shimizu | 96/94 |

OTHER PUBLICATIONS

"An Appraisal of Drying Systems," Fisher, O., *Photographic Engineering*, Vol. 4, 1953, pp. 226–230.

*Making And Coating Photographic Emulsions*, Zelikman, Vol. 1964, p. 30.

*Photographic Emulsion Chemistry*, Duffin, G. F., 1966, p. 158.

*Photographic Chemistry*, D. H. O. John, 1963, pp. 170–173.

*Primary Examiner*—David Klein
*Assistant Examiner*—Judson R. Hightower
*Attorney, Agent, or Firm*—Sughrue, Rothwell, Mion, Zinn & Macpeak

[57] ABSTRACT

In a process for producing a gelatino silver halide light-sensitive material containing a high silver halide content comprising applying a gelatino silver halide emulsion layer having a silver halide to gelatin weight ratio of at least 0.8 and a gelatin-containing protective layer to a non-hygroscopic film support having good dimensional stability and then drying the layers, the improvement which comprises drying the layers on the support when the water content becomes less than 300% based on the mean drying amount defined as:

$$\frac{\text{the weight of water in the layers}}{\text{the weight of solids on the support}} \times 100,$$

by contacting said material with air having a relative humidity of from 50 to 75%.

5 Claims, No Drawings

PROCESS FOR PRODUCING GELATINO-SILVER HALIDE PHOTOGRAPHIC LIGHT-SENSITIVE MATERIALS HAVING A HIGH SILVER HALIDE CONTENT

This is a continuation of application Ser. No. 35,547, filed May 7, 1970, now abandoned.

BACKGROUND OF THE INVENTION

1. Field of the Invention

The present invention relates to a process for the production of gelatino silver halide photographic light-sensitive material having a high content of silver halide. More particularly, it relates to a process for the production of a gelatino silver halide photographic light-sensitive material having, on a non-hygroscopic film support having good dimensional stability, a gelatino silver halide emulsion layer having a silver halide to gelatin ratio (by weight) of higher than 0.8, preferably from 1.0 to 4.0, and a protective layer containing gelatin.

2. Description of the Prior Art

The drying of gelatino silver halide photographic light-sensitive materials is conducted, after applying various layers to a support such as a gelatino silver halide emulsion layer and a gelatin-containing protective layer, by (a) setting the layers by contacting them with low-temperature air having a dry-bulb temperature of from −10° to 10°C, (b) supplying to the layers air having a dry-bulb temperature of 15°–45°C and a relative humidity of 10–35% in accordance with the dried state of the layers while carrying the light-sensitive material by means of either a suspension-type carrying method, a straight-type carrying method, an arch-type carrying method, a zigzag-type carrying method, or an air-support type carrying method, and c) then supplying thereto air having a dry-bulb temperature of 20°–26°C and a relative humidity of 50–75%. The photographic light-sensitive material thus dried has a moisture content suitable for storing for a long period of time.

The drying method described above gives good results in the drying of photographic light-sensitive material having a low silver halide content but one encounters difficulty by using the process in the drying of a photographic light-sensitive material having a high silver halide content to be used in a quick process and for high sensitivity and high resolving power.

In other words, when a photographic light-sensitive material having a high content of silver halide dried by the above-mentioned process is subjected to a developing process, the formation of fog is remarkably increased ("fog" as used in the present specification is defined as the amount of silver in the non-exposed portion of the emulsion layer reduced by the development).

This tendency is particularly remarkable when a gelatin-containing protective layer is formed on a high-content silver halide photographic light-sensitive material which utilizes a non-hygroscopic film having good dimensional stability, such as a polyester film as the support.

The above-mentioned difficulty is caused by the following reasons. Namely, as the weight ratio of silver halide to gelatin in the gelatino silver halide emulsion layer increases, the gelatin suddenly shrinks due to the action of the low-humidity air and the silver halide in the emulsion layer is apt to be influenced by this straining of the gelatin. Further, the tendency is accelerated when a film such as a polyester film, a polycarbonate film or a polystyrene film is used as the support, caused by the low shrinkability and the lack of hygroscopivity.

Therefore, an object of this invention is to provide a process for producing a silver halide photographic light-sensitive material having a high content of silver halide and having a silver halide emulsion layer and a protective layer on a non-hygroscopic support having good dimensional stability.

Another object of the present invention is to provide a drying process for a high-content silver halide photographic light-sensitive material without being accompanied with increased fog formation.

SUMMARY OF THE INVENTION

The objects of the present invention can be attained by applying to a non-hygroscopic support having good dimensional stability a gelatino silver halide emulsion layer having a silver halide to gelatin weight ratio of higher than 0.8 and a gelatin-containing protective layer, and then drying the layers on the support such that when the water content becomes less than 300%, based on a mean dry amount, the drying is with air having a relative humidity of from 50 to 75%.

DESCRIPTION OF THE PREFERRED EMBODIMENTS

In order to produce a high-content silver halide photographic light-sensitive material without causing increased fog formation, it is necessary to dry the light-sensitive material without straining the gelatin by shrinking the gelatin, and for this purpose, the photographic light-sensitive material having a water content of less than 300%, based on a mean dry amount as follows:

$$\left(\text{i.e., } \frac{\text{weight of water contained in layers}}{\text{weight of solids on the support}} \times 100\right),$$

may be dried using air having a relative humidity of from 50 to 75% and a dry-bulb temperature of from 2° to 35°C.

Further, it is necessary that the water content be lower than that required for the dry amount standard water content to be in a state of equilibrium with air of 50 to 75% relative humidity, i.e., it should not reach a value lower than 6–12%.

The above-mentioned mean dry amount standard moisture content of 300% is near the critical moisture content of a varying drying state, that is, each surface of the layers formed on the support is in a wet state during a constant rate drying period and is dried without the formation of a large water-content distribution in the direction of the layer thickness. However, during a falling-rate drying period less than the critical moisture content, a large moisture-content distribution begins to form in the width direction and at the same time a non-uniform drying state or uneven drying results, whereby the layers achieve a state which is likely to result in an extremely low moisture-content locally throughout the layer.

This tendency becomes remarkable when the light-sensitive material is rapidly dried using air having a low relative humidity, which increases the formation of fog. The dry amount standard moisture content necessary to obtain the state of drying air having a relative humidity of 50 to 75% is influenced by the average silver halide content in the silver halide emulsion layer applied to the support and the thickness of each layer after drying. The range of moisture content of the material may vary from a value above the dry amount standard moisture content necessary for a state of equilibrium to exist with air having a relative humidity of 50 to 75% to below that value, but generally if it is in a range lower than the critical water content, good results are obtained.

Moreover, in order to obtain a dry standard moisture content for defining the drying air within the above-mentioned range of 50 to 75% relative humidity, it is necessary that the dry amount standard moisture content in each layer formed on the support be maintained throughout the whole layer at a value lower than the dry amount standard moisture content necessary for a state of equilibrium to exist with air of 50 to 75% relative humidity.

The invention will be further illustrated by the following non-limiting examples.

EXAMPLE 1

A gelatino silver halide emulsion for negative film containing 50 mg/100cm$^2$ of silver halide and 45 mg/100cm$^2$ of gelatin and a protective layer containing gelatin were applied to a polystyrene film and after setting by cooling, the light-sensitive film was cut into two samples (A and B).

Sample A was dried using air having a dry-bulb temperature of 28°–32°C and a relative humidity of 25–30% and then subjected to humidity adjusting under conditions of a dry-bulb temperature of 22°C and a relative humidity of 60%.

Sample B was treated by the process of this invention. That is to say, the moisture constituting that above 300% of the average dry amount standard moisture content of sample B was dried with air at a dry-bulb temperature of 28°C and at a relative humidity of 30% and the water of less than 300% was dried at a drying temperature of 32°C and at a relative humidity of 60%, and then sample B was subjected to humidity adjusting by contacting with cooling air at a dry-bulb temperature of 22°C and at a relative humidity of 64%.

Both sample A and sample B were then subjected to the same amount of exposure through an optical wedge and then developed, fixed, washed, and dried under the same conditions.

The results of fog measurement about the two samples thus processed showed that the sensitivity of sample A was the same as that of sample B and the fog of sample B was about two-thirds of that of sample A.

EXAMPLE 2

A gelatino silver halide emulsion for X-ray film containing 100 mg/100cm$^2$ of silver halide and 35 mg/100cm$^2$ of gelatin was applied to a polyester film support together with a protective layer containing gelatin and after setting the layers by cooling, the light-sensitive film was cut into two samples (A and B).

Sample A was processed in a conventional manner, i.e., dried by air at a dry-bulb temperature of 28°–32°C and at a relative humidity of 25–30% and subjected to humidity adjustment by air at a dry-bulb temperature of 22°C, and at a relative humidity of 60%.

Sample B was processed according to the process of this invention. The water constituting more than 250% of the average dry amount standard moisture content was dried with air at a dry-bulb temperature of 30°C and at a relative humidity of 30%, the water of less than 250% of the moisture content was dried with air at a dry-bulb temperature of 32°C and at a relative humidity of 60%, and then the sample thus dried was subjected to humidity adjustment by cooling with air at a dry-bulb temperature of 22°C and at a relative humidity of 65%.

To the opposite surfaces of each of sample A and sample B thus dried was applied the same silver halide emulsion as above followed by setting by cooling. The samples were then dried and subjected to the humidity adjustment in a conventional manner about sample A and according to the process of this invention about sample B. Each of the samples having emulsion layers at both surfaces was exposed through an optical wedge to the same exposure amount and processed under the same conditions using a roller-type automatic developing machine.

The results of measuring the characteristics of the developed samples, such as sensitivity and fog, showed that the sensitivity of sample A was the same as that of sample B and the fog of sample A was 0.10, whereas the fog of sample B was 0.06.

What is claimed is:

1. In a process for producing a gelatino silver halide light-sensitive material containing a high silver halide content which includes applying first a gelatino silver halide emulsion layer having a silver halide to gelatin weight ratio of at least 0.8 and then a gelatin-containing protective layer to a non-hygroscopic film support having good dimensional stability, and then drying of said layers, the improvement which comprises drying said layers on the support in two stages wherein a. in a first stage said layers are dried to a water content less than 300% and near the critical moisture content with air having a relative humidity of from 10 to 35% and b. in a second stage said layers are dried to remove water content of less than 300% and below the critical moisture content with air having a relative humidity of from 50 to 75%, said water content being based on the mean drying amount as defined by:

$$\frac{\text{the weight of water in the layers}}{\text{the weight of solids on the support}} \times 100.$$

2. The process as in claim 1, wherein said air has a dry-bulb temperature of from 2° to 35°C.

3. The process as in claim 1, wherein said silver halide to gelatin weight ratio ranges from 1.0 to 4.0.

4. The process as in claim 1, wherein said protective layer is a gelatin layer.

5. The process as in claim 1, wherein said air employed has a relative humidity of 30%.

* * * * *